US005469984A

United States Patent [19]

Kalkanis

[11] Patent Number: 5,469,984

[45] Date of Patent: Nov. 28, 1995

[54] CONTAINER OF THERMOPLASTIC MATERIAL FOR CONTAINING LIQUIDS

[75] Inventor: Petros Kalkanis, Napplion, Greece

[73] Assignee: The Procter & Gamble Company, Cincinnati, Ohio

[21] Appl. No.: 211,188

[22] PCT Filed: Sep. 17, 1992

[86] PCT No.: PCT/US92/07871

§ 371 Date: Jul. 22, 1994

§ 102(e) Date: Jul. 22, 1994

[30] Foreign Application Priority Data

Sep. 27, 1991 [EP] European Pat. Off. ..... 91202524

[51] Int. Cl.[6] ..... B65D 6/38

[52] U.S. Cl. ..... 220/606; 220/608; 215/373

[58] Field of Search ..... 220/606, 608, 220/609; 215/1 C

[56] References Cited

U.S. PATENT DOCUMENTS

| | | | |
|---|---|---|---|
| 3,727,783 | 4/1973 | Carmichael | 215/1 C |
| 4,108,324 | 8/1978 | Krishnakumar et al. | 215/1 C |
| 4,174,782 | 11/1979 | Obsomer | 215/1 C |
| 4,231,483 | 11/1980 | Dechenne et al. | 215/1 C |
| 4,978,015 | 12/1990 | Walker | 215/1 C |
| 4,997,692 | 3/1991 | Yoshino | 215/1 C |

*Primary Examiner*—Joseph Man-Fu Moy
*Attorney, Agent, or Firm*—Dean L. Garner

[57] ABSTRACT

A container (1) of thermoplastic material for containing liquids comprises an anti-bulging base (5) comprising a flat ring-shaped section (9) and a central dome-shaped section (11). The diameter of the central dome-shaped section (11) is relatively large and comprises at least 60% of the diameter of the container (1). The central dome-shaped section (11) consists of a lateral wall (15) of relatively large radius of curvature and a relative flat cap (17). The ring-shaped section (9) acts as a spring, giving away to internal pressure build-up in the container, which preferably is a household bleach bottle of polyethylene. Thus the pressure on the central dome-shaped part (11), which is designated for minimum thickness and maximum strength, is relieved.

7 Claims, 2 Drawing Sheets

CONTAINER OF THERMOPLASTIC MATERIAL FOR CONTAINING LIQUIDS

FIELD OF THE INVENTION

The invention relates to a container of thermoplastic material for containing liquids, the container having a side wall and a base connected to the side wall, the base generally extending transverse to the side wall, the base comprising a curved section connected to the sidewall, a ring-shaped section connected to the curved section , the ring-shaped section having an inclination with respect to a plane perpendicular to a longitudinal axis of the container and a central dome-shaped section connected to the curved section.

BACKGROUND OF THE INVENTION

Such a container is known from the European Patent EP-A-002082.

In this patent a bottle is described which is made of oriented thermoplastic material, such as vinyl chloride-based resins, polymers and co-polymers of acrylic acid or polyesters such as polytherephtalate of ethyleneglycol. In order for the known bottle to have a better resistance to deformation due to build-up of internal pressures and to lateral shocks, such as occur when the bottle is dropped during transportation, the central dome-shaped part has a certain minimum diameter, preferably less than 40% of the total diameter of the bottle.

After blow-moulding of bottles of thermoplastic material, it is for fast production of the bottles required that they release easily from the mould. To reduce the production cycle time, the bottles are released from the mould at the limiting condition of the bottles, and especially the base, being solid but still hot. Bottles having a central dome-shaped part of too small a diameter will, upon opening of the mould, release with difficulty and require removal from the mould by mechanical loosening means or by hand.

Bottles of thermoplastic material that are optimized according to strength, i.e. having relatively thick walls, rather than by using a minimum amount of material, have as a disadvantage that during blow moulding of the bottles, the cooling of the bottles takes longer, such that production rates will be lowered.

It is also known to reinforce the base of bottles of thermoplastic material by, instead of forming a central dome-shaped part, providing the base with a reinforcement rim, or by providing the base with a number of reinforcing depressions. It was found that for bottles containing products such as a bleach containing for example 2% of chlorine were still subject to outward bulging of the base despite reinforcement thereof at elevated temperatures (50° C. and higher) due to large internal pressure build-up. This makes the bottles unstable in the upright position, causing them to fall off shelves or toppling over in kitchen cabinets.

OBJECTS OF THE INVENTION

It is an object of the invention to provide for a container of thermoplastic material that has a large resistance against deformation due to build-up of internal pressure, especially at elevated temperatures.

It is another object of the invention to provide for a container that has a minimum thickness, such that material costs will be as low as possible.

It is again another object of the invention to provide for a container of thermoplastic material that can easily and efficiently be manufactured at high speeds.

SUMMARY OF THE INVENTION

A container of thermoplastic material is thereto characterized in that the central dome-shaped section has in the plane of a cross-section perpendicular to the base, the plane comprising a central, longitudinal axis of the container, a dimension that is larger than 60% of a dimension, $d_c$, of the container along the cross section, both dimensions being measured in a direction perpendicular to the central, longitudinal axis, the central dome-shaped section comprising a lateral wall of radius of curvature $r_1$ such that $0.03\ d_c<r_1<0.22\ d_c$ and a cap of radius of curvature $r_2$ such that $0.3\ d_c<r_2<1.6\ d_c$.

By the container according to the invention, that is preferably of generally cylindrical shape, but that can be of ellipsoidal or square shape, and at a wall thickness of 1.0 mm, an internal pressure of 1N mm 2 (about 10 atm.) can be contained without any significant bulging. Since pressures that occur in bottles containing liquids that release gases, are in every day situations never in excess of 1 atm., the stability of the shape of the bottle according to the invention is guaranteed. For bottles according to the invention having a wall thickness of 1.5 mm it was found that after 6 days of storage at 60° C., still no bulging did occur, compared to serious bulging after 3 hours of a known bottle of the same thickness at the same temperature. The bottle according to the invention achieves a large strength at thin wall thickness by the curved section of the sidewall and the ring-shaped section acting as a spring that elastically extends to alleviate pressure on the central dome-shaped part. The sharp radius of curvature $r_1$ of the lateral wall of the dome-shaped section and the large radius of curvature $r_2$ of the cap of the central dome-shaped section ensure a stiff central part, optimized for minimum thickness. Because of the relatively broad central dome-shaped part, the bottle simply releases from the mould by its self upon opening of the mould, while the relatively thin wall thickness allows fast cooling after blow- or injection moulding of the bottle and therefore allows for fast production rates.

An embodiment of a container according to the invention is characterized in that the base comprises at least three outward projections on which the container is supported.

When the bottle is released from the mould while still being hot, contraction of the curved section and the ring-shaped section can occur upon cooling of the bottle, that is for instance made of polyethylene. This contraction causes an uneven base, affecting the stability of the bottle in the upright position. The provision of the protrusions at the base lifts the base slightly (0.5 mm) off the supporting surface, such that despite local unevenness of the base a stable upright positioning of the bottle is possible.

DETAILED DESCRIPTION OF THE INVENTION

Figure 1:
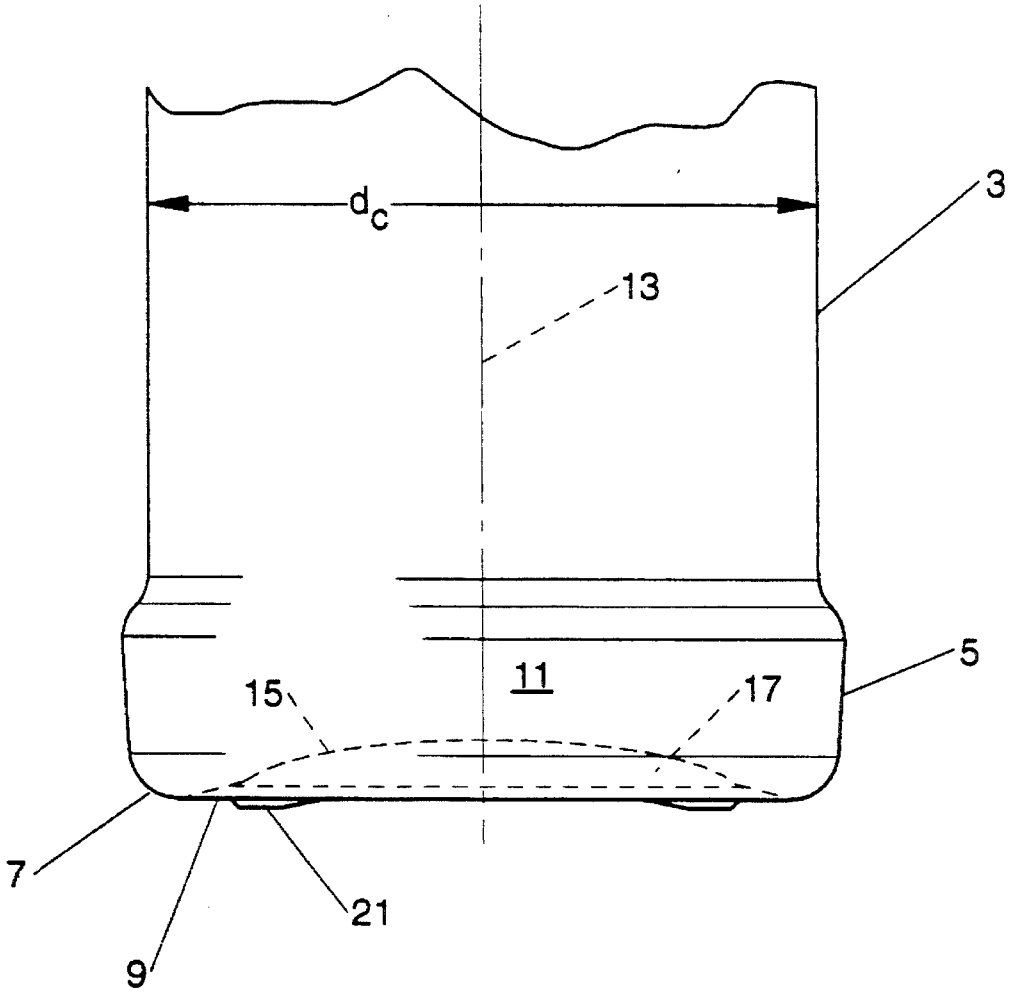

An embodiment of a container according to the invention will be explained in detail with reference to the accompanying drawing. In the drawing FIG. 1 shows a side-view of a bottom part of a bottle having a base according to the invention FIG. 2 shows a side-view of a bottle having a known base comprising a reinforcement structure and FIG. 3 shows a bottom-view of the bottle of FIG. 2.

FIG. 1 shows a container 1, in particular a bottle of polyethylene having a wall-thickness of 1.5 mm and a contents of 1.6 l for containing liquid household bleach.

The bottle 1 comprises a sidewall 3 and a base 5 on which the bottle is supported in an upright position. Due to release of gases from the liquid contents of the bottle, an over pressure of 0.5 atm. can build up inside the bottle, especially at elevated temperatures. The pressure build-up can cause outward bulging of the base 5 which can make the bottle unstable and topple. In order to prevent bulging, the base 5 comprises a curved section 7 connected to the side wall 3, a ring-shaped section 9 and a central dome-shaped section 11. The ring-shaped section 9 has an inclination with respect to the plane perpendicular to a longitudinal axis 13 of the bottle and acts as spring, giving away under internal pressure (hydrostatic pressure of liquid contents and pressure build-up) to alleviate the pressure on the central dome-shaped section 11. The central-dome shaped section 11 is relatively wide and shallow which allows an easy release of the bottle from the mould after blowing. For a 1.6 l bottle of wall-thickness 1.5 mm as is shown in the figure, the general diameter $d_c$ of the bottle is 125 mm, but varies along the longitudinal axis 13 from about 120 mm to 129 mm. The central dome-shaped part 11 has a diameter of 80 mm and consists of a lateral wall 15 having a radius of curvature $r_1$ of 28 mm and a cap 17 having a radius of curvature $r_2$ of 200 mm. These dimensions allow for a bottle of optimum strength, without the necessity of reinforcement structures comprising additional material.

Figure 2:
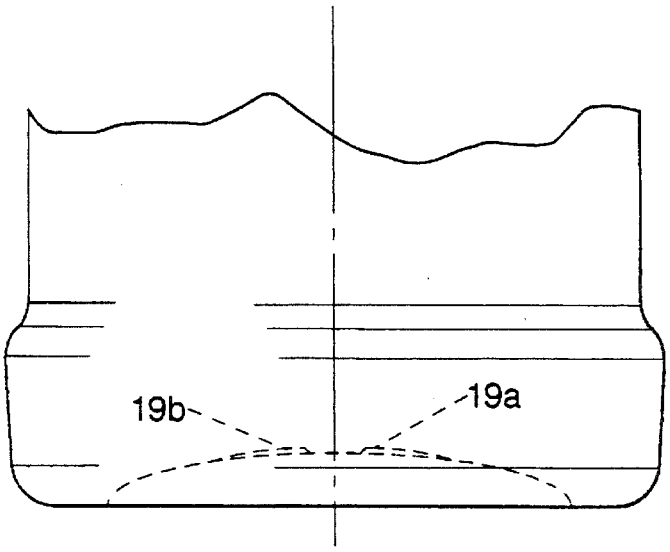
Figure 3:
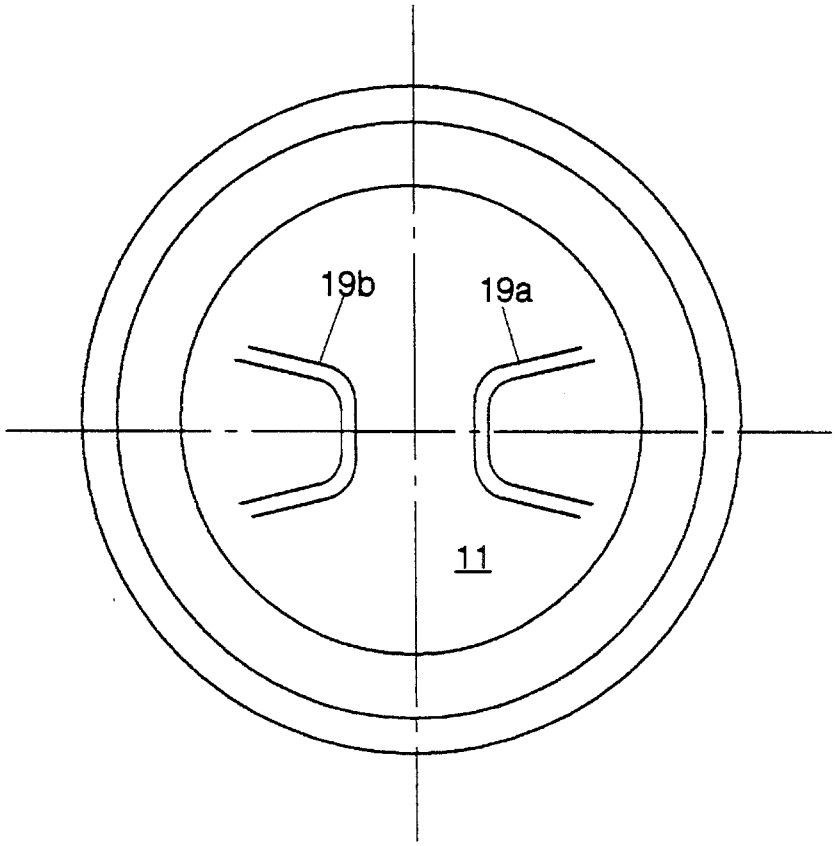

FIG. 2 shows a side view of a known bottle, the base of which comprises a reinforcement structure 19*a*, 19*b*.

FIG. 3 shows a bottom view of the known bottle. The central dome-shaped part 11 comprises two radii of curvature $r_1$ and $r_2$ of respectively 28 and 300 mm. On top of the central dome-shaped part 11, two reinforcement rims 19*a* and 19*b* of 2 mm in height are provided. No ring-shaped section 9 is present. A polyethylene bottle according to the invention and a bottle as shown in FIGS. 2 and 3 of the same material were for several wall thicknesses tested under equal conditions. The bottles had a content of 2.5 l of household bleach and were stored at a temperature of 60° C. For the known bottle having a wall thickness of 0.6 mm serious bulging, causing instability of the bottle, was observed after 3 hours. For the known bottle having a wall thickness of 2 mm, serious bulging, causing instability of the bottle, was observed after 12 hours. For the bottle according to the invention having a wall thickness of 1 mm, slight bulging was observed after 72 hours, without the bulging causing instability of the bottle. After 168 hours, the bulging had not significantly increased. For bottles according to the invention and having a wall thickness of respectively 1.5, 2.0 and 2.5 mm, no bulging was observed after 168 hours. In practice, the preferred thickness of the bottle will be 1.5 mm, giving the bottle a firm structure.

The cross-section of the bottle is not limited to being cylindrical, but can be of general ellipsoid or rectangular shape. If in case of for instance an ellipsoid bottle, the base fulfills for all cross-sections perpendicular to the base, such as along the long or the short axis of the base, the dimensional requirements of the invention, a strong bottle comprising a minimum of material is obtained.

For stability, the bottle is supported on four supportive feet 21, which allow for stable positioning of the bottle even in case the ring-shaped section 9 is uneven due to contraction of the thermoplastic material of the bottle after moulding.

I claim:

1. Container of thermoplastic material for containing liquids, the container having a side wall and a base connected to the side wall, the base generally extending transverse to the side wall, the base comprising:

a curved section connected to the sidewall, a ring-shaped section connected to the curved section, the ring-shaped section having an inclination with respect to a plane perpendicular to a longitudinal axis of the container and a central dome-shaped section connected to the curved section, wherein the central dome-shaped section has in the plane of a cross-section perpendicular to the base, the plane comprising a central, longitudinal axis of the container, a dimension that is larger than 60% of a dimension, $d_c$, of the container along the cross section, both dimensions being measured in a direction perpendicular to the central, longitudinal axis, the central dome-shaped section comprising a lateral wall of radius of curvature $r_1$ such that $0.03\ d_c<r_1<0.22\ d_c$ and a cap of radius of curvature $r_2$ such that $0.3\ d_c<r_2<1.6\ d_c$.

2. Container according to claim 1, characterized in that the dimension of the central dome-shaped part is substantially equal to 64% of the dimension of the container, $d_c$.

3. Container according to claim 1 or 2, characterized in that, the radius of curvature $r_1$ of the side wall is 23% of the dimension $d_c$ of the container, the riadius of curvature $r_2$ of the cap being 160% of the dimension $d_c$ of the container.

4. Container according to claim 1, characterized in that the wall thickness of the container is between 0.6 and 2.0 mm.

5. Container according to claim 1, characterized in that the container is made of polyethylene.

6. Container according to any of claim 1, characterized in that the base comprises at least three outward projections on which the container is supported.

7. Container according to claim 1, characterized in that the container has a volume of between 1 and 5 liter.

* * * * *